United States Patent [19]

Tipton

[11] 4,025,589

[45] May 24, 1977

[54] METERING ROD SUPPORT FOR CARBURETOR

[75] Inventor: Larry J. Tipton, Florissant, Mo.

[73] Assignee: ACF Industries, Incorporated, New York, N.Y.

[22] Filed: Sept. 2, 1975

[21] Appl. No.: 609,295

[52] U.S. Cl. ..... 261/69 A; 251/DIG. 4; 251/122

[51] Int. Cl.[2] ..... F02M 7/16

[58] Field of Search ..... 261/69 R, 51, 69 A; 251/DIG. 4, 122

[56] References Cited

UNITED STATES PATENTS

| | | | |
|---|---|---|---|
| 1,961,747 | 6/1934 | Ewart | 251/122 |
| 2,452,956 | 11/1948 | Robins | 251/122 |
| 2,619,333 | 11/1952 | Carrey | 261/51 |
| 2,936,789 | 5/1960 | Krein | 261/51 |
| 2,964,303 | 12/1960 | Smith et al. | 261/51 |
| 3,100,236 | 8/1963 | Ott et al. | 261/51 |
| 3,653,642 | 4/1972 | Lawrence | 261/44 R |

*Primary Examiner*—Tim R. Miles

[57] ABSTRACT

A metering rod support for a carburetor for an internal combustion engine in which a vertical extending metering rod is positioned in a metering jet to control the flow of fuel to the fuel nozzle discharging in the air and fuel mixture conduit. An integral one-piece hanger member wholly supports the metering rod and has a downwardly extending leg which contacts and continuously urges the metering rod in a horizontal direction into contact with the inner peripheral surface defining the metering jet thereby to provide improved flow characteristics. The one-piece hanger member is formed of a molded plastic material and when employed with an adjusting screw for varying the height of the metering rod receives the adjusting screw in a tight fit within an internally threaded opening.

8 Claims, 9 Drawing Figures

86A
114
102A
60A
106A
104A
66A
68A 118
86A
114
116
60A
82A
84A 14
16
42
77
44
78
20
18
76
74
18

10
82
86
110
84
88
90
85

22
32
40
30
58
44
52
50
54
34
24
26

METERING ROD SUPPORT FOR CARBURETOR

BACKGROUND OF THE INVENTION

Heretofore, metering rods have been suspended by a metallic hanger and in the event the metering rod was maintained in contact with a side of the orifice formed by the metering jet, a separate spring element has been mounted on the hanger support to urge the metering rod into engagement with the side forming the orifice such as shown in U.S. Pat. No. 2,099,106 issued Nov. 16, 1937. When the metering rod is in contact with one side of the orifice, the flow will remain substantially the same for a given suction and the flow rate may be calibrated accurately. If the metering rod could be accurately held in the center of the orifice without interfering with the longitudinal movement of the metering rod the carburetor would function properly but no practical and convenient means of doing this is available particularly in view of manufacturing tolerances resulting from mass production. Thus, it is desirable to have the metering rod continuously held in engagement with the side forming the orifice in which the lower end of the metering rod is positioned.

Additionally, heretofore, an adjusting screw for adjusting the height of the metering rod during the flow testing has been provided and in order to maintain such setting accurately, a spring has been positioned between the hanger support for the metering rod and the head on the adjusting screw.

DESCRIPTION OF THE INVENTION

A carburetor has a metering rod with a reduced diameter lower end portion fitting within an orifice defined by a metering jet. The metering rod support comprising the present invention includes a one-piece hanger member having a main body with an outer projection thereon wholly supporting the metering rod thereon in a suspended relation. The hanger member further includes a resilient integral leg extending downwardly from the main body alongside the metering rod and the leg has a generally U-shaped lower cross member thereon forming a loop. The metering rod fits within the loop to deflect the leg laterally and the resilience of the leg urges continuously the metering rod into engagement with the side of the orifice formed by the metering jet. The hanger member is preferably formed of a molded plastic material such as, for example, nylon, and thermoplastic material reinforced with glass fibers. Thus, the one-piece hanger member wholly supports the metering rod in addition to continuously urging the metering rod into engagement with the side of the orifice in which the lower end of the metering rod is received. An adjusting screw for adjusting the height of the metering rod for calibration purposes is threaded into an internally threaded opening in the main body and the adjusting screw is held in position by engagement with the plastic without the provision of any separate spring member. The tolerance between the adjusting screw and hanger member is tightly controlled with the molded plastic material.

When employed with an accelerating pump, the hanger member has an opening therein receiving the pump rod and moves upwardly with the pump rod upon rapid accelerartion thereby to raise the metering rod simultaneously. In one embodiment of the invention, the hanger member has an outwardly extending cylindrical projection about which the eye of a metering rod is mounted to support wholly the metering rod. Another embodiment has an opening in an extension on the hanger member in which a crank-like upper end portion of the metering rod fits for wholly supporting the metering rod therein. In all embodiments, a resilient downwardly extending leg is formed integrally with the main body to contact and urge the metering rod into engagement with the side of the orifice formed by the metering jet.

The adjusting screw on the hanger member is accessible from a position outside the carburetor so that the adjusting screw may be adjusted during flow testing for calibration purposes. Accessibility is provided by having an opening in the carburetor wall at a location in vertical alignment with the adjusting screw so that a workman may engage the adjusting screw with a screwdriver or the like for adjusting purposes.

The invention for purposes of illustration and description is shown in the accompanying drawings, forming a part of the specification, wherein.

Figure 6:
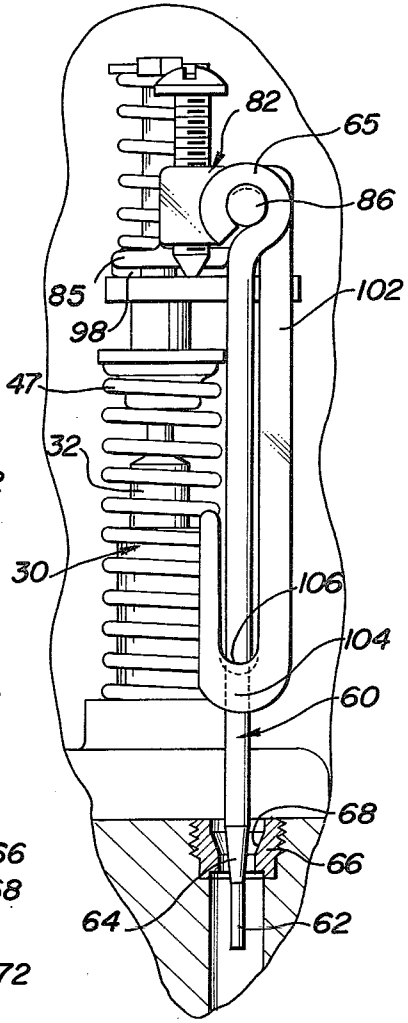
FIG. 6 is a front elevational view of the hanger member shown in FIG. 5.
Figure 5:
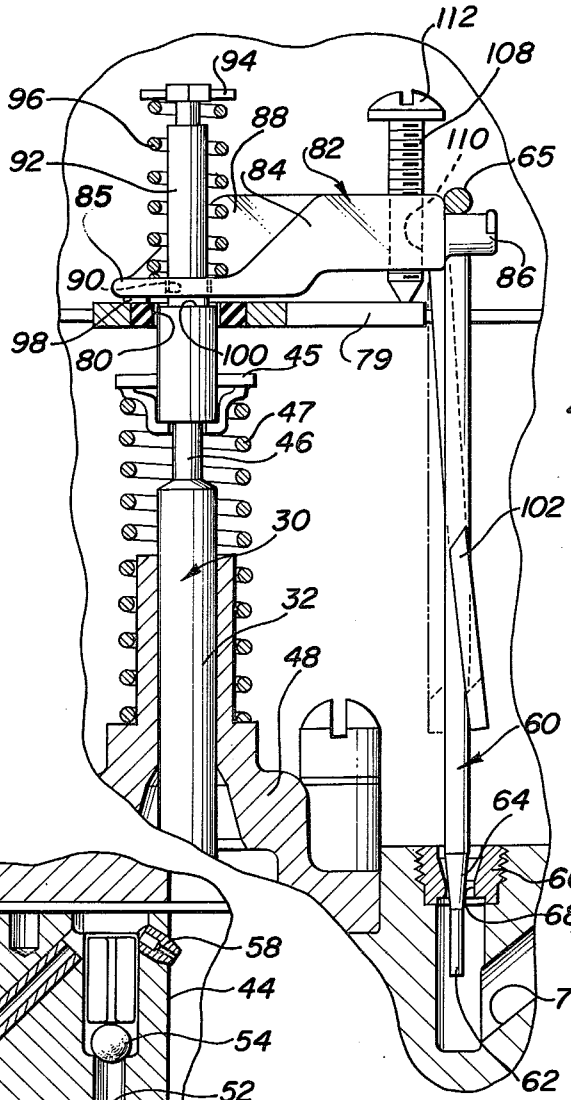
FIG. 5 is an enlarged fragment of FIG. 1 showing the one-piece hanger member comprising the present invention wholly supporting a metering rod and urging the metering rod into engagement with the adjacent side of the metering orifice.
Figures 2, 4, 7, 8, 9:
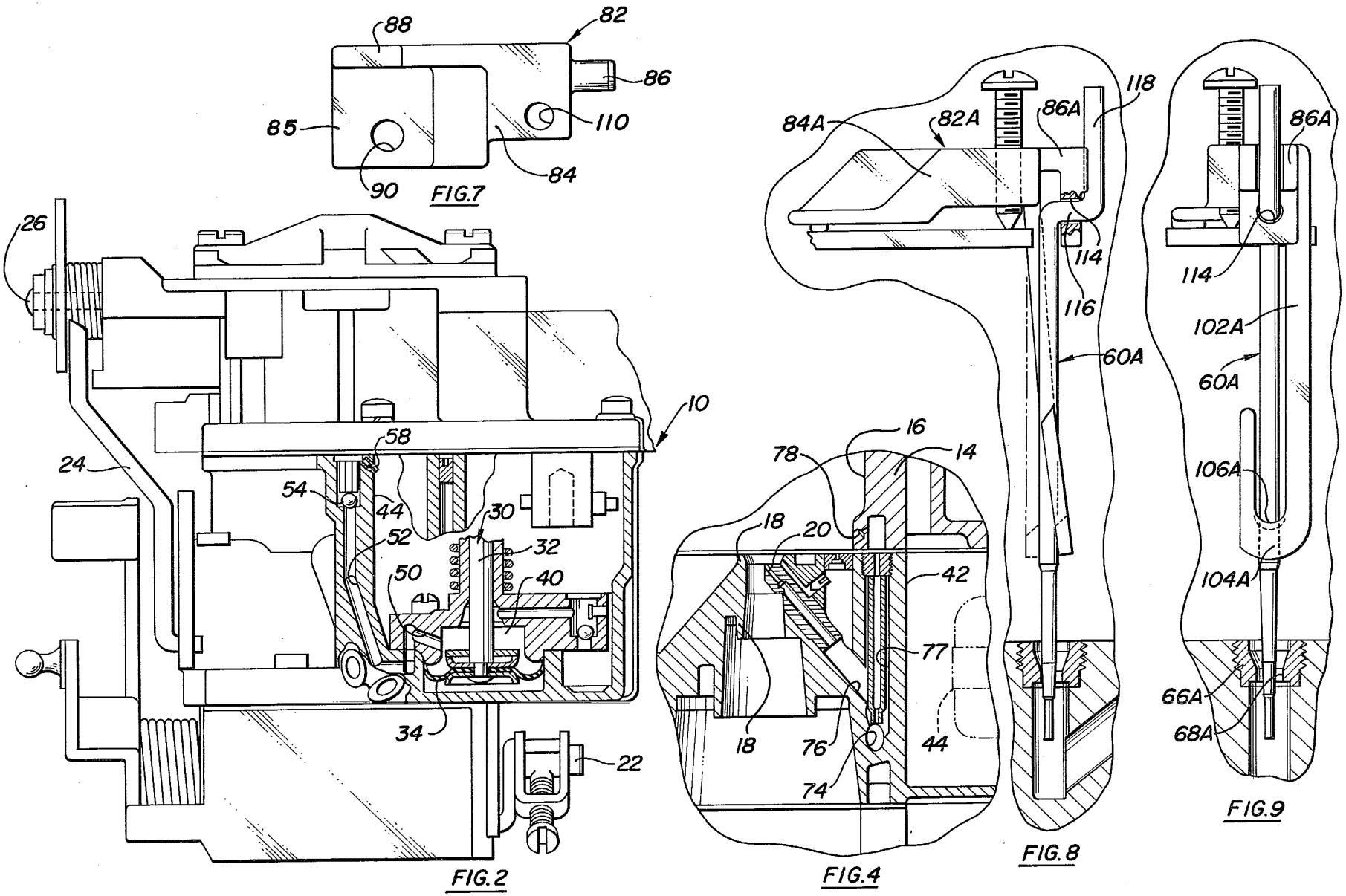
FIG. 2 is an elevational view with certain parts broken away and shown in section of the carburetor shown in FIG. 1 and illustrating the flow passage from the accelerating pump.
FIG. 4 is a partial vertical section showing the air and fuel mixture conduit of the carburetor shown in FIGS. 1 and 2.

FIG. 7 is a plan view of the hanger member of FIGS. 5 and 6 removed from the carburetor; FIG. 8 is a side elevational view of another embodiment of the hanger member of the present invention in which the metering rod has an upper crank-like end portion supported within an opening in the hanger member; and FIG. 9 is an end elevation of the hanger member shown in FIG. 8 illustrating the resilient downwardly extending leg having a lower U-shaped loop in engagement with the metering rod to hold the metering rod in engagement with the side of the adjacent orifice.

Referring now to the drawing for a better understanding of this invention, and more particularly to the embodiment shown in FIGS. 1–7, a carburetor indicated generally at 10 has a lower flange 12 by means of which it may be attached to the manifold of an internal combustion engine. Carburetor 10 has a main body 14 forming an air and fuel mixture conduit at 16 in which one or more venturis 18 are provided and a main nozzle 20 discharges into the upper venturi 18. As shown in FIG. 2, a throttle valve (not shown) is mounted on a throttle shaft 22 and suitable linkage at 24 is connected to a shaft 26 for controlling the movement of a conventional air valve (not shown) as is well-known.

Figure 3:
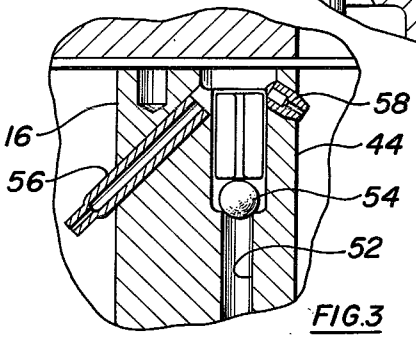
FIG. 3 is an enlarged section view of the fuel flow passage from the accelerating pump to the air and fuel mixture conduit.

An accelerating pump is indicated generally at 30 and includes a pump rod 32 having a diaphragm 34 connected adjacent its lower end. A vacuum chamber 36 is formed on the lower side of the diaphrahm 34 and a part 38 in chamber 36 is connected by a suitable passage to the intake manifold of an internal combustion engine. Fuel is supplied to chamber 40 on the upper side of diaphragm 34 through a port 42 which is connected by a suitable fuel passage to the fuel bowl indicated at 42 in FIG. 4 and having a float 44 as is well-known. Pump rod 32 has a spring retainer 45 thereon fitting about an intermediate reduced diameter portion 46 of pump rod 32. A spring 47 is biased between retainer 45 and pump body 48 forming chamber 40. Spring 47 continuously urges pump rod 32 and diaphragm 34 upwardly. As shown in FIG. 2, upon upward movement of pump rod 32, fuel in chamber 40 is forced through passage 50 to bore 52. Referring to FIG. 3, fuel in passage 52 unseats a ball check valve 54 and flows through a nozzle 56 into the air and fuel mixture conduit 16. Excess fuel may blow through nozzle 58 into fuel bowl 44. Diaphragm pumps of the type herein described are well known in the art and a more complete description can be found in U.S. Pat. to Carrey, No. 2,619,333 and dated Nov. 25, 1952.

A metering rod indicated generally at 60 has a reduced diameter lower end portion 62, a tapered intermediate lower end portion 64 and an eye 65 at its upper end. A metering jet 66 forms a metering orifice 68 in which lower end portions 62 and 64 of metering rod 60 are received. Upon a vacuum being exerted adjacent the tip of nozzle 20, fuel is drawn from fuel passage 72 through port 74 to fuel passage 76 leading to nozzle 20 for discharge into venturis 18. A bypass fuel passage 77 leads to a bypass port 78 for discharge into the air and fuel mixture conduit 16.

A support plate 79 is fixed to the body of carburetor 10 and has an opening 80 receiving pump rod 32.

Referring now to an important feature of the present invention, a hanger member is indicated generally at 82 and includes a main body portion 84 and a generally cylindrical outwardly extending projection 86. Eye 65 of metering rod 60 fits about projection 86 and metering rod 60 is wholly supported therefrom. Main body portion 84 has a lower wall 85 and a side wall 88. Lower wall 85 has an opening 90 therein receiving an upper reduced diameter portion 92 of pump rod 32 therein. A spring retainer 94 is secured to the upper end of pump rod 32 and a coil spring 96 is biased between wall 85 and retainer 94 to continuously urge pump rod 32 upwardly. An abutting surface 100 formed by reduced diameter portion 92 engages the undersurface of bottom wall 86 upon an upward movement of pump rod 48 when a rapid acceleration is provided in the internal combustion engine and a relatively small vacuum is exerted on the lower surface of diaphragm 34.

Figure 1:
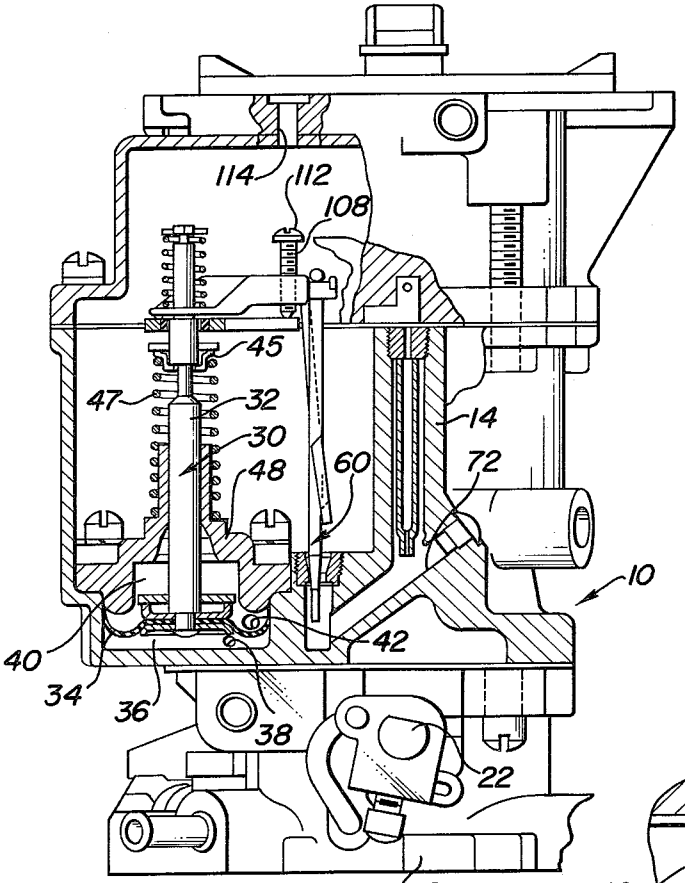
FIG. 1 is a generally vertical section of a carburetor having an accelerating pump, certain parts being shown in elevation, and showing the support for the metering rod comprising the present invention.

Extending downwardly from main body 84 is a leg 102 formed integrally with main body 84. Leg 102 has generally U-shaped loop 104 adjacent its lower end forming a cross member and a pocket 106 to receive metering rod 60. Body 84 and leg 102 are integral parts of hanger member 82 and preferably formed of a resilient molded plastic material, such as, for example, nylon, polyesters, or thermoplastics reinforced with glass fibers. Tolerances may be tightly controlled with molded plastic products which is highly desirable for mass production. As shown in FIG. 5, leg 102 has a resilience sufficient to displace a distance at least equal to the diameter of rod 60. When metering rod 60 is placed within pocket 106, leg 102 is urged outwardly by metering rod 60 and the resilience thereof urges metering rod 60 laterally into engagement with the side of orifice 68. Thus, metering rod 60 is continuously held in engagement with the side of orifice 68 formed by metering jet 66. To adjust the height of metering rod 60 for calibration purposes, a threaded adjusting screw 108 is threaded within an internally threaded opening 110 in body 84. Head 112 of adjusting screw 108 may be engaged by a screwdriver or the like for adjusting metering rod 60 to the proper height. It is noted that no spring is necessary between hanger member 82 and adjusting screw 108 in order to hold adjusting screw 108 in the proper position. The relatively tight fitting between the screw threads of hanger body 84 and the external screw threads of adjusting screw 108 is sufficient to prevent any free rotation of adjusting screw 108. As shown in FIG. 1, an opening 114 is provided in the wall of the carburetor in vertical alignment with adjusting screw 108 in order to permit a workman or the like to insert a screwdriver or the like in head 112 from a position outside the carburetor.

From the foregoing, it is to be understood that a support for a metering rod has been provided which is formed of a one-piece molded plastic material. The support includes means to support wholly metering rod 60 and a downwardly extending leg in which metering rod 60 fits so as to be urged laterally into engagement with the side of metering orifice 68. While the embodiment shown in FIGS. 1–7 has been shown in combination with an acceleration pump 30, it is to be understood that the one-piece molded plastic hanger support which supports wholly metering rod 60 may be employed with carburetors not having an accelerating pump.

In operation, during rapid acceleration, the pressure differential between chamber 36 and chamber 40 is reduced to result in an upward movement pump rod 30. This forces fuel from fuel chamber 40 through passages 50 and 52 to nozzle 56. Simultaneously, hanger member 82 is raised by surface 100 of pump rod 32 to lift metering rod 60 thereby to increase the flow of fuel through orifice 68 and passages 72 and 76 to main fuel nozzle 20.

Referring now to the embodiment of the invention shown in FIGS. 8 and 9, a hanger member 82A is shown having a main body 84A and an outer projection 86A in which an opening 114 is provided. A metering rod 60A has a crank-like upper end portion forming a horizontal metering rod portion 116 and an upper offset vertical portion 118 in staggered relation to the lower end portion of metering rod 60A. Horizontal portion 116 fits within opening 114. An integral leg 102A has a lower loop 104A forming a pocket 106A receiving metering rod 60A and urges metering rod 60A laterally against the side of metering orifice 68A of metering jet 66A in the same manner as the embodiment of FIGS. 1–7.

What is claimed is:

1. A carburetor for an internal combustion engine comprising:

a. a body structure having an air and fuel mixture conduit therethrough;

b. a throttle valve mounted across said mixture conduit for movement between open and closed position;

c. a fuel nozzle within the mixture conduit, a fuel supply bowl adjacent the mixture conduit, a fuel passage between the supply bowl and the fuel nozzle, a metering jet within the fuel passage defining a metering orifice, a vertically extending metering rod having a lower end portion positioned within the orifice to control the flow of fuel to the fuel nozzle, d. an integral one-piece hanger member wholly supporting the metering rod and continuously urging the metering rod in a generally lateral direction to maintain contact between the outer periphery of the metering rod and the adjacent surface defining the orifice, and e. a fixed support means to support the said hanger member, and an adjusting screw between the hanger member and the fixed support means to adjust the height of said metering rod relative to said metering jet.

2. A carburetor for an internal combustion engine as set forth in claim 1 wherein said one-piece hanger member is formed of a molded plastic material.

3. A carburetor for an internal combustion engine as set forth in claim 1 wherein said one-piece hanger member has a main body and a generally cylindrical projection extending horizontally from the main body, and said metering rod has an eye adjacent its upper end fitting about said projection for supporting the metering rod in a suspended relation.

4. A carburetor for an internal combustion engine as set forth in claim 1 wherein said one-piece hanger member has a main body and an arm extending generally vertically downwardly alongside said metering rod, said downwardly extending arm having an integral laterally extending portion in engagement with the rod and urging the rod in a generally horizontal direction against the adjacent surface forming the orifice.

5. A carburetor for an internal combustion engine as set forth in claim 1 wherein said one-piece hanger member has a main upper body and a leg extending generally vertically downwardly alongside said metering rod, said leg having a generally horizontally extending opening adjacent its upper end and an integral laterally extending portion adjacent its lower end, said rod having a crank-like upper end portion fitting within said opening and being engaged and urged laterally adjacent its lower end by said laterally extending portion.

6. A carburetor for an internal combustion engine comprising:

a. a body structure having an air and fuel mixture conduit therethrough;

b. a throttle valve mounted across said mixture conduit for movement between open and closed positions;

c. a fuel nozzle within the mixture conduit, a fuel supply bowl adjacent the mixture conduit, a fuel passage between the supply bowl and the fuel nozzle, a metering jet within the fuel passage, a vertically extending metering rod having a lower end portion positioned within the metering jet to control the flow of fuel to the fuel nozzle;

d. an accelerating pump adjacent the mixture conduit mounted for vertical reciprocation, said pump including a vertically extending rod having an upper end portion adjacent the upper end of said metering rod and a diaphragm secured to its lower end responsive to manifold vacuum;

e. a one-piece hanger member wholly supporting the metering rod in suspended relation and having a downwardly extending leg engaging and continuously urging the metering rod horizontally into engagement with the adjacent surface defining the metering jet, said hanger member having a main body extending between the metering rod and pump rod and having an opening therein receiving the pump rod, said hanger member being movable vertically with said pump rod and upon rapid acceleration said pump rod moves upwardly to raise said hanger member and metering rod to supply additional fuel to the air and fuel mixture conduit; and f. wherein a fixed support means supports the said hanger member, and an adjusting screw between the said hanger member and fixed support means adjusts the height of said metering rod relative to the metering jet, said adjusting screw being accessible from a position outside the carburetor.

7. A carburetor as set forth in claim 6 wherein a manifold vacuum port is in fluid communication with the lower side of the pump diaphragm and a fuel supply is provided adjacent the upper side of the pump diaphragm, and a pump fuel passage extends from the fuel supply to the mixture conduit whereby upon rapid acceleration said pump rod and diaphragm move upwardly to supply fuel to the mixture conduit through the pump fuel passage.

8. A carburetor as set forth in claim 6 wherein said pump rod has a reduced diameter upper end portion fitting within the opening of said hanger member body and terminating in an annular abutment adjacent the hanger member, said pump rod having a spring retainer on its upper end and a spring biased between said retainer and the hanger member to urge continuously said abutment toward said hanger member.

* * * * *